US007343020B2

(12) United States Patent
Thigpen

(10) Patent No.: US 7,343,020 B2
(45) Date of Patent: Mar. 11, 2008

(54) VEHICLE AUDIO SYSTEM WITH DIRECTIONAL SOUND AND REFLECTED AUDIO IMAGING FOR CREATING A PERSONAL SOUND STAGE

(76) Inventor: F. Bruce Thigpen, 1026 Merritt Dr., Tallahassee, FL (US) 32301

( * ) Notice: Subject to any disclaimer, the term of this patent is extended or adjusted under 35 U.S.C. 154(b) by 694 days.

(21) Appl. No.: 10/664,040

(22) Filed: Sep. 17, 2003

(65) Prior Publication Data

US 2004/0109575 A1 Jun. 10, 2004

Related U.S. Application Data

(60) Provisional application No. 60/411,386, filed on Sep. 18, 2002.

(51) Int. Cl.
*H04R 5/02* (2006.01)

(52) U.S. Cl. ..... 381/302

(58) Field of Classification Search ..... 381/302, 381/86, 160, 408–409, 431, 332–333
See application file for complete search history.

(56) References Cited

U.S. PATENT DOCUMENTS 4,612,530 A * 9/1986 Kurth et al. ..... 340/429
4,819,269 A * 4/1989 Klayman ..... 381/307
5,031,220 A * 7/1991 Takagi et al. ..... 381/86
5,966,453 A * 10/1999 Koyano et al. ..... 381/86
6,104,825 A * 8/2000 Thigpen ..... 381/408
6,389,147 B1 * 5/2002 Rush et al. ..... 381/389
6,584,202 B1 * 6/2003 Montag et al. ..... 381/63
2002/0076061 A1 * 6/2002 Ashtiani et al. ..... 381/86
2002/0081980 A1 * 6/2002 Reus ..... 455/90
2003/0021433 A1 * 1/2003 Lee ..... 381/302
2003/0108211 A1 * 6/2003 Dreyer et al. ..... 381/86
2004/0047476 A1 * 3/2004 Sato ..... 381/89
2006/0034467 A1 * 2/2006 Sleboda et al. ..... 381/86

* cited by examiner

*Primary Examiner*—Vivian Chin
*Assistant Examiner*—Lun-See Lao
(74) *Attorney, Agent, or Firm*—Dowell & Dowell, PC

(57) ABSTRACT

Automotive audio systems that use directional planar magnetic transducers in a layout or placement configuration to provide direct or reflected audio imaging in stereo or surround sounds for individual passengers of an automotive vehicle with reduced crossed audio interference.

14 Claims, 6 Drawing Sheets

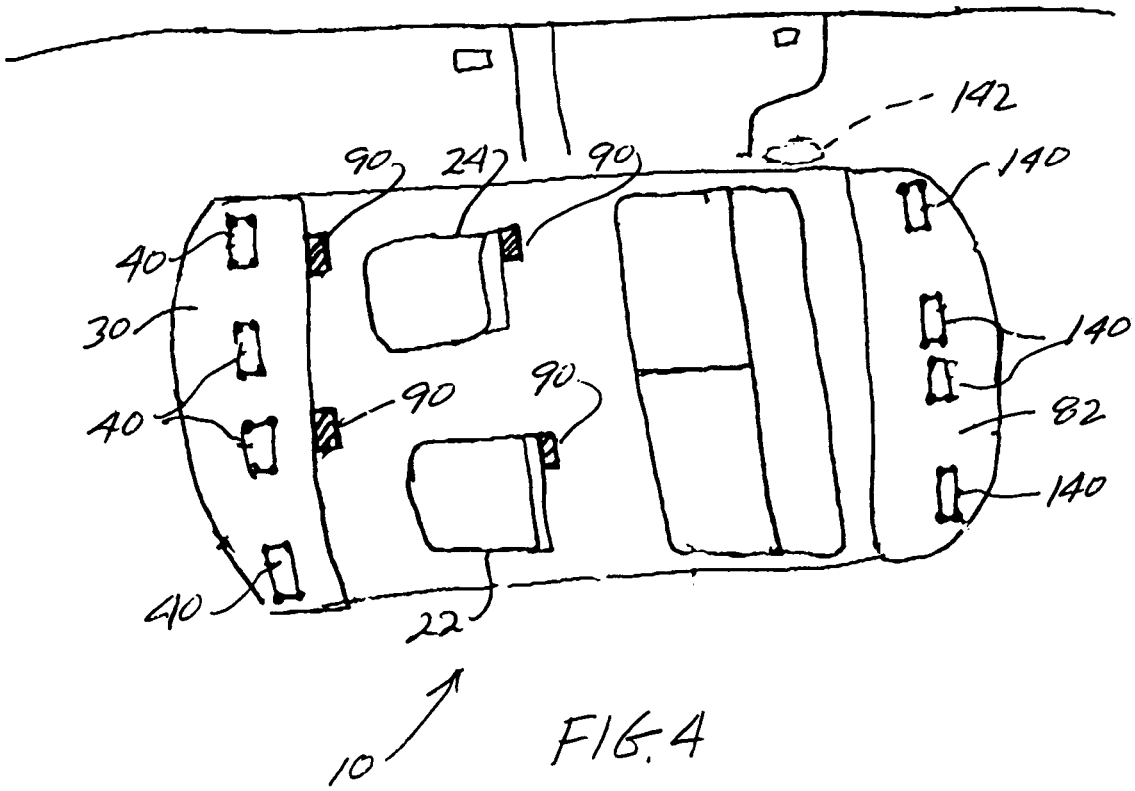
FIG. 4
FIG. 5
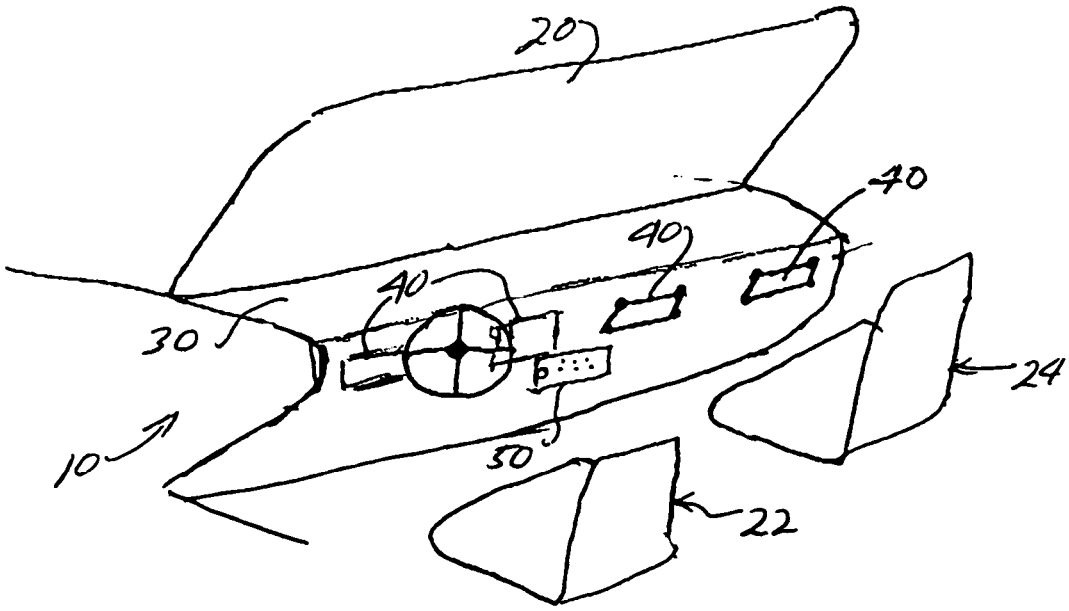

Figure 7 Example of directional characteristics of a 4x8" planar magnetic transducer along the wide axis demonstrating narrow polar response curve Figure 8 Cross Talk comparison of standard speaker vs directional transducer mounted in orientation described by invention

VEHICLE AUDIO SYSTEM WITH DIRECTIONAL SOUND AND REFLECTED AUDIO IMAGING FOR CREATING A PERSONAL SOUND STAGE

CROSS REFERENCE TO RELATED APPLICATIONS

This application claims the benefit of U.S. Provisional Application Ser. No. 60/411,386, filed Sep. 18, 2002.

BACKGROUND OF THE INVENTION

1. Field of the Invention

This invention is directed to the field of automotive sound systems of the type used in cars, trucks and the like and more particularly to direct and reflected sound imaging using planar magnetic transducers for the source of sound generation. The transducers are mounted and oriented within a vehicle such that separate stereo or surround sound stages are created for each passenger while cross talk or cross interference is reduced when compared with conventional sound systems.

2. Description of the Related Art

Conventional automotive speaker layouts use left and right transducers that are placed at opposite sides of an automotive vehicle. This results in unequal sound arrival amplitude and time cues such that there is little or no stereo image perceived by a passenger. A center channel will move the image to the center of the vehicle, but the same limitations apply and there is limited ability to project sound around the passengers. Digital time delays have been employed to move the image to one side of the vehicle, but this only works for one passenger. The sound quality in the remainder of the vehicle is degraded. Limited alternative approaches have used standard voice coil center speaker(s) or DSP delays with standard voice coil speakers in different locations, however, both approaches have limitations in sound or imaging quality over a full frequency range.

Directional transducers have well known desirable characteristics but have traditionally had limited implementation in vehicles due to lower efficiency, high cutoff frequencies, and mounting limitations. Small flat panel transducers used as a dipole have difficulty achieving sufficient acoustic output at moderate distances below 400 Hz. This is a problem because the speakers cannot interface directly with a subwoofer. Using an interior portion of a vehicle as an infinite baffle or ported enclosure reduces the low frequency limitation and small flat panel transducers can interface directly with a subwoofer.

Hence there is currently no high quality solution for an improved stereo image over a full range for individual sound in an automotive vehicle. Also there is a need for a high quality, small, flat panel transducer that can be mounted within a vehicle to achieve low frequency response while having output levels high enough for automotive listening.

SUMMARY OF THE INVENTION

The invention is directed to a flat panel planar magnetic or electrostatic speaker layout that provides an isolated separate left/right channel or surround sound system for each occupant of an automotive vehicle. By using directional transducers, the sound source can be made to come from directly in front of a passenger by acoustic reflections within the passenger compartment. Due to the directional characteristics of the transducers, this layout can have a separate stereo or surround images that are separately balanced and with separate tone, volume and program controls for each passenger.

In accordance with the invention, a pair of spaced planar magnetic transducers are mounted, such as along the vehicle dashboard, such that the longest longitudinal axis of the transducers are linearly aligned with one another and are generally parallel to a listening position located in a front seat of the vehicle. In preferred embodiments, the transducers are mounted so as to direct sound toward the vehicle windshield so sound waves are reflected toward a passenger seated in the listening position.

Using the system layouts of the invention, pairs of transducers are mounted forwardly of each front passenger seat with subwoofers mounted in spaced relationship thereto, such as within the side door or side interior compartment areas of the vehicle. In this manner, separate sound stages are created for each front seat passenger. Due to the characteristics of the planar magnetic transducers, there is a reduction in the amount of cross talk or interference with respect to the stereo sound received by each passenger.

In further embodiments of the invention, pairs of planar magnetic transducers are also mounted to the rear of each of the front seat listening positions. The rear transducers are also mounted such that their longest longitudinal axes are linearly aligned and are generally parallel to the front seat listening positions. In some embodiments, the rear transducers are mounted so as to reflect sound waves off the rear window of the vehicle toward the front seat listening positions. In this manner, a stereo surround stage is created for each listening position. Other rear compartment mounting arrangements are also disclosed. Also, additional subwoofers may be provided in the rear passenger compartment for creating sound stages for the rear seat passengers.

It is an object of the invention to provide a high quality stereo image to individual passenger positions within an automotive vehicle with reduced cross talk between other passenger audio systems such that each passenger has individualized sound and tone controls.

It is another object of the invention to provide high quality stereo or stereo surround audio images to individual passenger positions in an automotive vehicle wherein the use of high frequency tweeters is not necessary to obtain a full sound frequency range within the vehicle.

It is a further object of the invention to allow high quality stereo or stereo surround audio images using different program material protocol available for each passenger such as music for one passenger and cell phone for another.

BRIEF DESCRIPTION OF DRAWINGS

A better understanding of the invention will be had with reference to the accompanying drawings wherein:

FIG. 4 is a top plan illustrational view of a vehicle audio system having reflected directional stereo sound design for front and rear passengers;

FIG. 5 is an illustrational view of another embodiment of vehicle audio system having direct directional stereo sound;

DESCRIPTION OF THE PREFERRED EMBODIMENTS

The invention is described with respect to several preferred embodiments as mounted within an automotive vehicle. However, the invention can be applied to non-vehicle designs such as angled display screens and the like.

Figure 1:
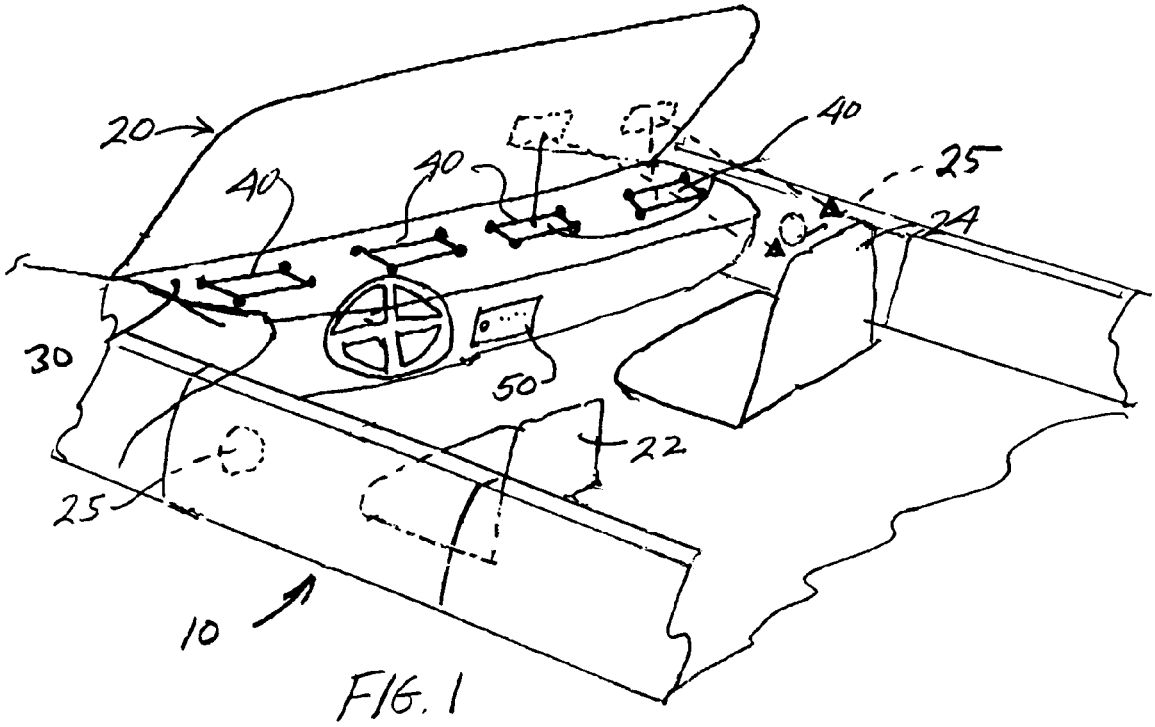
FIG. 1 is an illustrational view of a vehicle audio system using reflected directional stereo sound in accordance with the teachings of the present invention.

With particular reference to FIG. 1, an automotive vehicle 10, is shown having a windshield 20 and front dashboard 30. The windshield is typically angled towards the passenger seats, and slightly curved. As is typical in most vehicles, an audio source 50 is mounted along a front of the dashboard for easy access by passengers, and is electrically connected (not shown) to audio transducers to produce stereo sound. Directional acoustic transducers 40 are mounted as left and right pairs in holes or openings formed in the top surface of the front dashboard 30, using standard fasteners. Planar magnetic transducers are examples of transducers 40 providing required directionality at higher frequencies. Such transducers are often designed in rectangular shapes with a length approximately twice the width to produce a pleasing response. Examples of such transducers are disclosed in U.S. Pat. Nos. 4,837,838 and 5,901,235 to Thigpen et al.

In accordance with the invention, the transducers are placed or installed such that the long axis A-A of the acoustic transducers is parallel to a front edge of the seats, such that the sound from each transducer is reflected off the windshield 20 and directed to the passenger's ears, while retaining stereo image due to the directional qualities of the transducer. Due to the orientation of the directional speakers, the so-called sweet spot of optimum listening is narrow in the horizontal plane and wider in the vertical plane to provide for maximum isolation of each pair of speakers 40 from other pairs and to provide similar sound quality to a range of passenger heights. The invention provides for improved stereo imaging for each passenger when compared to conventional designs.

The reflection of a conventional cone type wide dispersion loudspeaker will sometimes result in a comb filtered frequency response curve. This is because the direct and reflected sound waves occur at about the same amplitude, but travel different distances thereby arriving at different times and thus canceling some frequencies. With the present invention, most of the sound energy arrives from the reflective surface and at the same time, thus reducing comb filtering.

Figure 7:
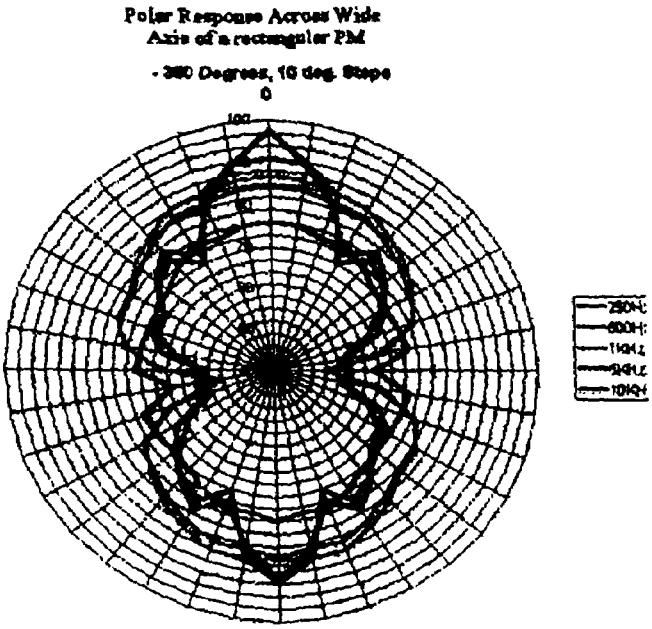
FIG. 7 is an example of directional characteristics of a 4×8" planar magnetic transducer along its wide axis demonstrating a narrow polar response curve.

A flat panel planar magnetic transducer includes a stretched film diaphragm that exhibits directivity patterns similar to theoretical prediction. These types of transducers exhibit modal characteristics across the surface of the diaphragm. However they distinguish themselves from exciter driven type flat panel speakers because the wavelengths of the modal patterns on the surface of the diaphragm are usually very small relative to the acoustic wavelength being projected. Therefore, the planar magnetic speaker looks like a moving flat plate to the air and directivity is maintained. In the system layouts described herein, this type of directivity is ideal.

Where the wavelengths are small relative to the dimensions of the transducer, the speaker becomes directional. This needs to occur roughly above 1.0 kHz for good subjective channel separation. The vertical or elongated axis A-A of the transducer has better high frequency dispersion than the horizontal or narrower axis B-B, see FIG. 2. In order for an acoustic system to function properly, cross talk or interference between transducers must be minimized. The polar curves of FIG. 7 show that a transducer layout with the transducer diaphragm axes A-A aligned between adjacent transducers provides the best acoustic separation. In the layout of the present invention, the rectangular planar magnetic speakers 40 are placed across the dash in end-to-end relationship with the long axes thereof oriented perpendicular to the vehicle front listening positions 22 and 24 where passengers are to be seated. This allows for good vertical dispersion to maintain high frequency response for passengers of different height or seat positions.

The elongate axis A-A of a rectangular planar magnetic speaker exhibits a very narrow sound individually to each ear of each occupant. The directivity characteristics of a 4 inches by polar response curve. In the layouts disclosed, this is desirable to maintain the ability to 8 inches rectangular planar magnetic speaker show that positioning the longest or elongate axis A-A of the transducer perpendicular to the listener will provide the best separation.

With the transducer layout used as a stereo or surround sound system in an automobile, three separate acoustic images result. The left and right passengers hear a correct stereo image and a center passenger hears a reversed image. The system layout of the present invention is able to resolve separate acoustic left and right stereo or surround audio images at distances of up to 1.5 meters with spacing as narrow as 0.33 meters.

In some existing premium automotive speaker systems, each side of the automobile uses a midrange and tweeter to maintain good dispersion and frequency response. Planar magnetic transducers can operate over a wide enough range, with low distortion, such that no tweeter is used. The transducer count is the same, two transducers per channel. The thin profile and lightweight of a planar magnetic transducer provides further advantages to the automotive interior designer. The sharp directivity of this type of transducer provides more flexibility in installation because the sound level of a reflection at high frequencies will be greater than the direct sound. The reflection off of the windshield creates the illusion that the sound is coming directly from in front of the passenger. Because each ear only perceives one transducers output, sound position can be moved around the listener by varying the left and right channel amplitude and phase.

Conventional stereo and surround signal sources can be used without the need for any special processing. A conventional cone type speaker or flat exciter driven panel will not project a convincing acoustic image onto the glass because of the wide dispersion associated therewith. With the same transducer layout, the wide and uniform dispersion of a conventional transducer prevents the projection of sound to each ear individually.

Figure 6A:
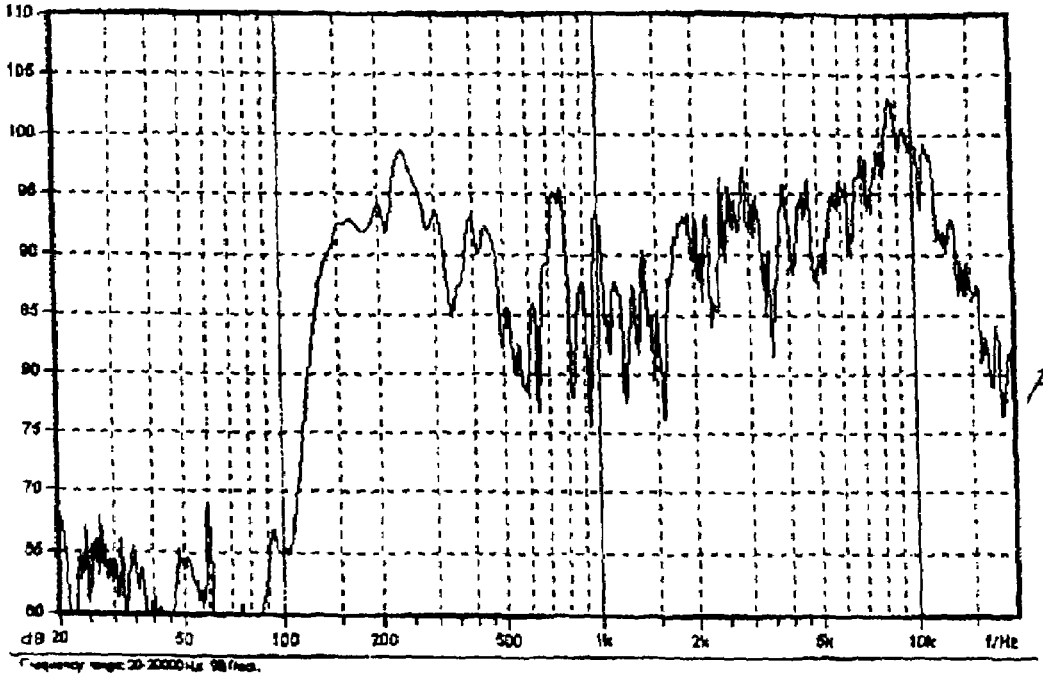
FIGS. 6*a* and 6*b* are graphs of reflected frequency response of reflected directional stereo sound of a pair of planar magnetic transducers mounted in the dashboard of a vehicle such as shown in FIGS. 1 and 2.
Figure 6B:
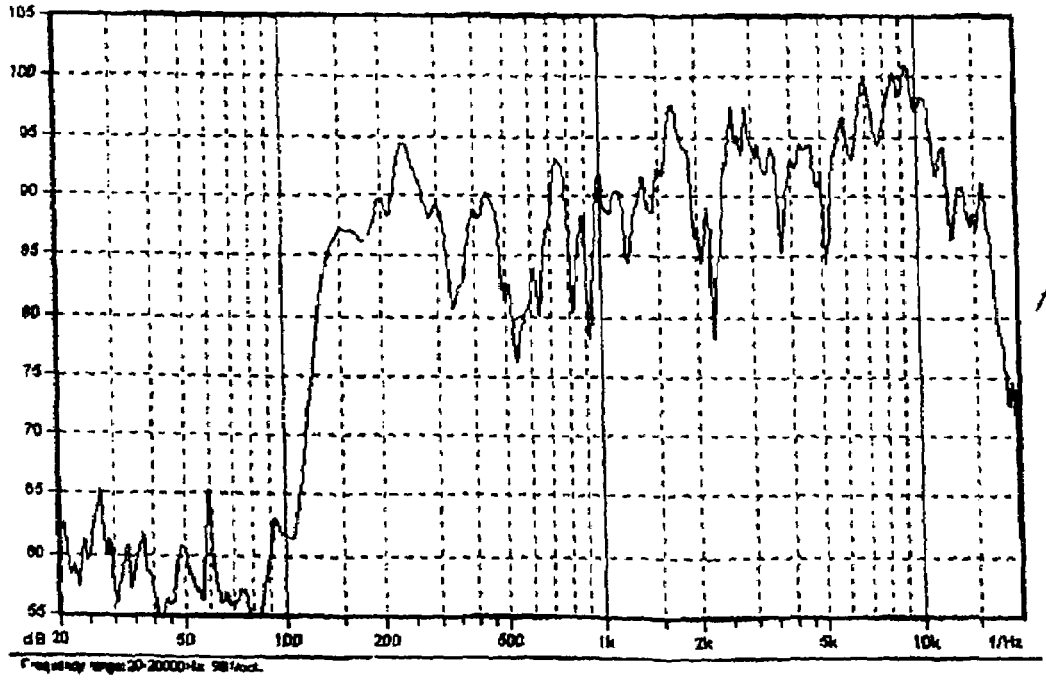

A concern of automotive audio designers is reproducing adequate low frequency response, particularly with planar speaker designs. The performance of the present systems has been tested and there is good output down to mid-bass frequencies, as shown in FIGS. 6A and 6B. Test data shows that, for example, a model MM700/1000 transducer (Sonigistix Corporation) works well with no modifications and should crossover to a woofer at about 150 Hz-180 Hz, and is thus suitable for automotive systems. Dashboard space can be a limitation depending on a design of an automobile's interior. However, the space problem can be overcome with a smaller version of the same transducer 40.

With the layout of the present invention, efficiency is comparable to other speaker technologies and the thin profile and lightweight transducers offer additional advantages. Test data shows good enough low frequency extension to blend with a subwoofer and high frequency performance is excellent so that no tweeter is necessary. Subwoofers 25 can be installed within a vehicle interior in a number of suitable locations such as in the side doors.

Another concern of automotive audio designers is to insure a suitably wide sound stage (the area of sound surrounding each passenger). However, most current systems have limited stereo sound stages except in the center of the car, due to door mounted speakers. The individual audio soundstage of the invention provides a suitable stereo soundstage width for each passenger typically confined to a restricted seat and head placement area.

Figure 2:
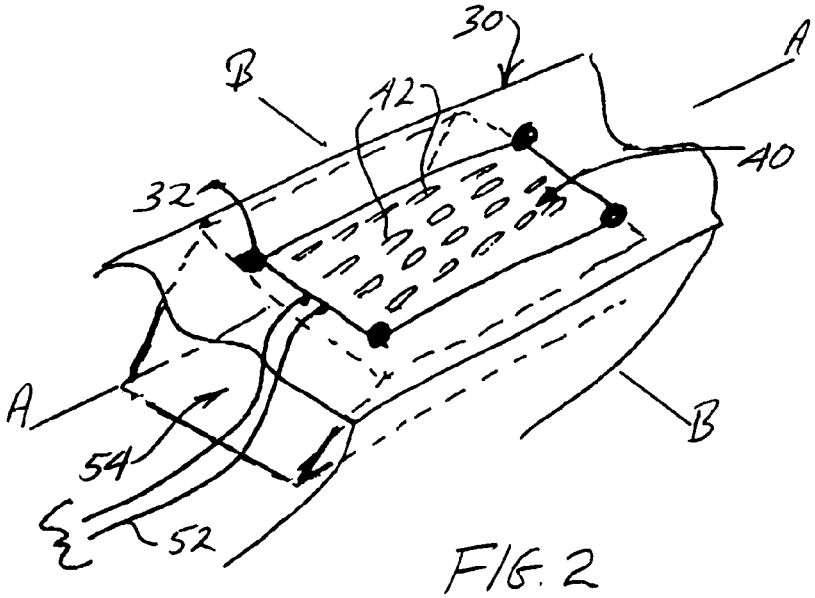
FIG. 2 is a perspective illustrational view of a planar directional speaker of the type used in the system of FIG. 1 mounted in a vehicle dashboard with enclosure.

With particular reference to FIG. 2, a partial perspective view shows the mounting of the directional acoustic transducer 40 described in FIG. 1. In this example, the directional transducer is a planar magnetic transducer 40 having sound holes 42 on the opposite sides thereof and mounted to the dashboard 30 with fasteners 32. The transducer is electrically connected to the audio source 50 by electrical leads 52. An acoustic cavity 54 is provided below the transducer and is tuned to provide maximum low frequency response. With the correct air load and acoustic volume behind the transducer 40, a low frequency response is obtained which increases low frequency output before diaphragm bottoming results with the frame of the transducer. The cavity 54 may vary in form and volume depending on available space for each vehicle design. While it is preferred that the cavity be acoustically sealed, embodiments of the invention may have a non-sealed space behind each speaker, which has the advantages of reducing parts and simplicity of design. Tests have shown the non-sealed design to be suitable.

Figure 3:
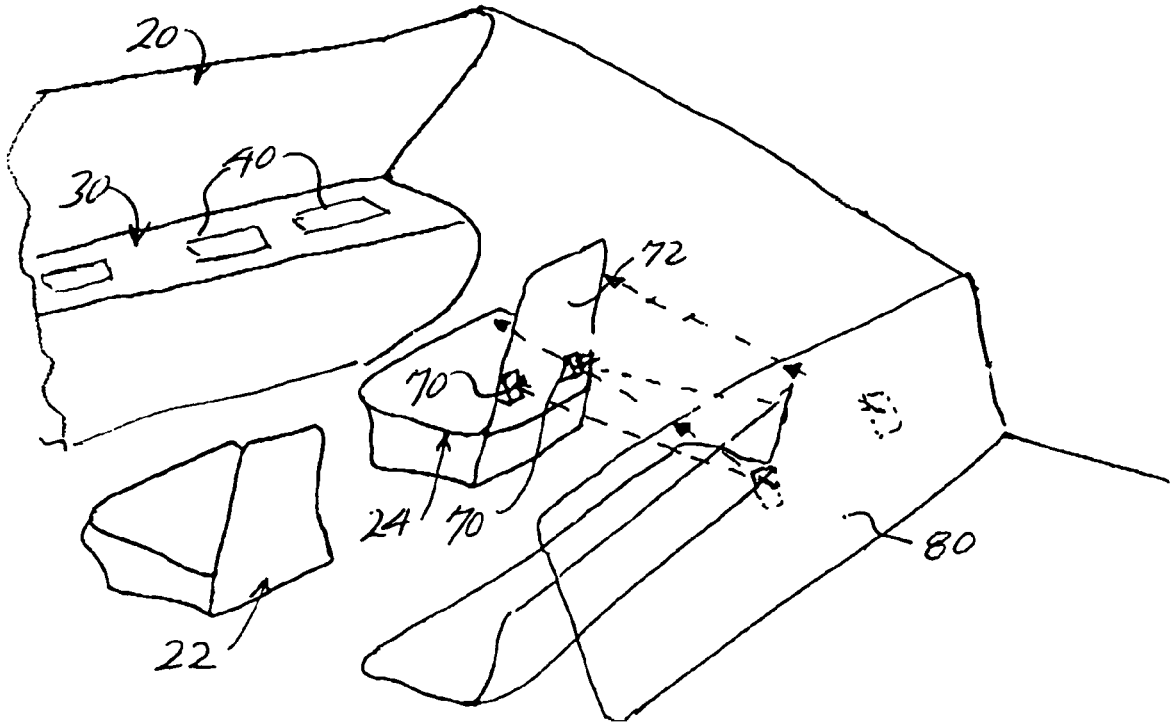
FIG. 3 is an illustrational view of a vehicle surround audio system with reflected directional sound incorporating rear channel transducers in the backside of a vehicle's front seats in accordance with the invention.

As audio sources playback surround processed audio, there is a desire to generate high quality surround sound for each passenger, thus requiring rear channel speakers and potentially a center channel speaker. With reference to FIG. 3, an embodiment allowing personal surround sound is shown. In this embodiment, a pair of rear speakers 70 is mounted on the backside 72 of the front passenger seat 24. The rear speakers include directional acoustic transducers such as the planar magnetic transducers. The speakers 70 are directed to reflect sound off the back window 80 toward the front and rear passengers. However, the two rear directional speakers could be mounted overhead to direct rear sound off shoulders 74 of the passenger seat 24. The use of reflected sound for the rear channel is advantageous due to the natural delay time that creates a perceived surround sound. Additionally, both the front and rear passengers are able to listen to this rear channel from the same reflected stereo image. The lower sound output level at the front seat relative to the rear seat is insignificant as rear channel audio is generally lower in output. The speakers 70 may be mounted on an angled mount to optimize the reflected angle and imaging for both front and rear seats. The directional transducers enable this configuration as the direct sound to the rear passenger head location is minimized.

Another embodiment of the invention includes added pairs of rear speakers to provide individual sound for two rear passengers, as shown in top view in FIG. 4. Two pair of rear directional transducers 140 mounted to the rear deck 82 by suitable fasteners in a similar orientation and spacing as described with respect to the front dashboard 30. Again, a reflected and directional audio image is provided to rear passengers by reflected sound off the back window 80. Optionally, the four speaker pairs may be used with matching subwoofers 142 and are connected to the audio source 50.

An additional option shown in FIG. 4 provides for individual controls 90 for each of the four pair of speakers. The controls ideally are located for ease of adjustment by each passenger and, in the example shown, are located on the front dashboard 30 and on the rear 72 of the front passenger seats 24. The controls may include volume, tone, balance and program selection, and are electrically connected to the audio source 50, which for this embodiment will output four separate audio stereo channels, which can be individually controlled. The controls can be hardwired or use a short range wireless WFI or optical transmission or bluetooth standard to communicate with the audio source 50. The individual controls could of course be applied to the front dashboard system shown in FIG. 1 or in combinations of stereo pairs. The individual controls could also be integrated into the audio source electronics 50 for master control. An example of new uses are to have voice program material on one side of the vehicle, such as a radio or phone conversation, while an adjacent occupant is listening to music on the other side.

In another embodiment of the invention as shown in FIG. 5, the directional audio transducers 40 are mounted in the dashboard 30 in the same orientation as before, but located facing the passenger to provide direct stereo sound with no reflections from the windshield 20.

Figure 8:
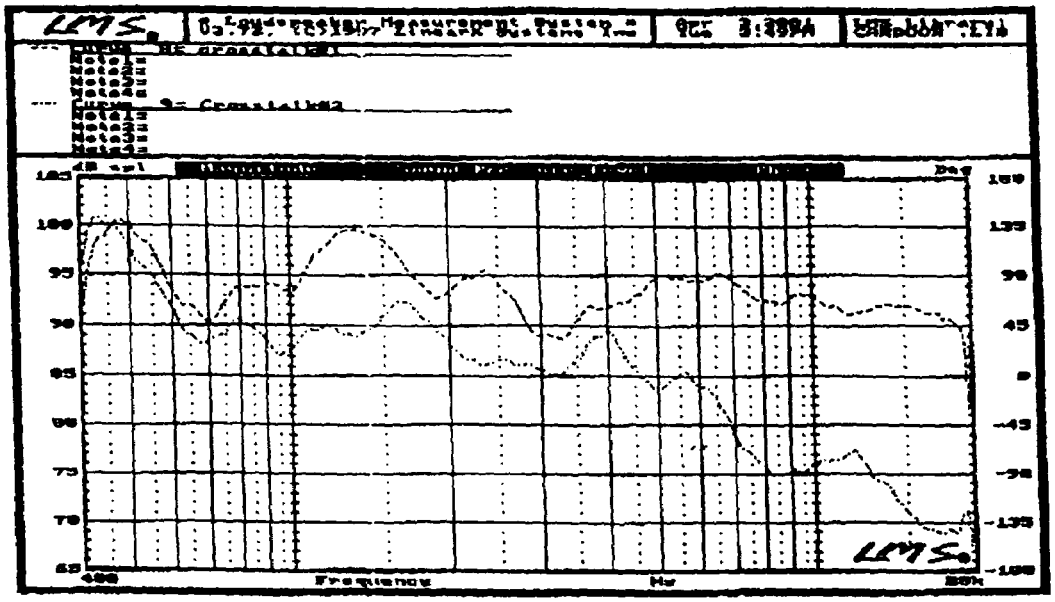
FIG. 8 is a graph of cross talk comparison of a conventional voice coil speaker vs directional transducer mounted in an orientation of the present invention.

One traditional inhibition to adopting individual speaker pairs for automotive audio designs has been a concern about significant cross talk or interference from one listening area to others, as would be expected using standard voice coil speakers. The invention represents a significant enhancement for this problem. FIG. 8 demonstrates the advantages of the invention as configured in the reflective design of FIG. 1. in comparison to a similar design using conventional non-directional voice coil speaker pairs mounted in the same way. The signal was measured at the left passenger listening location with the pair of speakers on only the right side being powered. A surprisingly large reduction in cross talk is demonstrated across the midrange and high frequencies, for the directional audio system. This is advantageous both for reproduction of the same program in multiple individual areas or for reproduction of different programs in individual areas.

The directional transducers described can typically be operated into ultrasonic frequencies and, the advantages of the present invention apply in this region. An example would be to mount microphones (not shown) in a vehicle dashboard to pick up reflected stereo ultrasound signals and, using signal processing common in the art, determine whether a passenger is seated in the seat and attributes specific to the passenger, such as their height. Such information could be used with other automotive automation and safety features including air bag disable features for short passengers.

An additional embodiment utilizes ultrasonic signals incorporating a modulated audio signal on an ultrasonic carrier (either amplitude or frequency modulated), which can be demodulated to audible sound at a listening position to retain the ultrasonic transmitters (not shown) mounted in the dashboard in a similar stereo configuration as the audible directional transducers, and provided with additional amplifier electronics (not shown) such as well known in the art for modulating and transmitting ultrasonic frequencies.

Another embodiment of the invention (not shown) is the use of a heads up display projected or emitted from a windshield location where the passenger perceives the stereo audio image to be directed from. This embodiment allows for stereo image audio cues to be played in response to the location or type of visual information displayed by the heads up display. Such a system would not be possible with conventional vehicle speaker systems. An example would be where weather information is displayed on the right side of the display area, with a corresponding audio cue panned to the right to sound as if it is coming from the weather information displayed.

Figure 9:
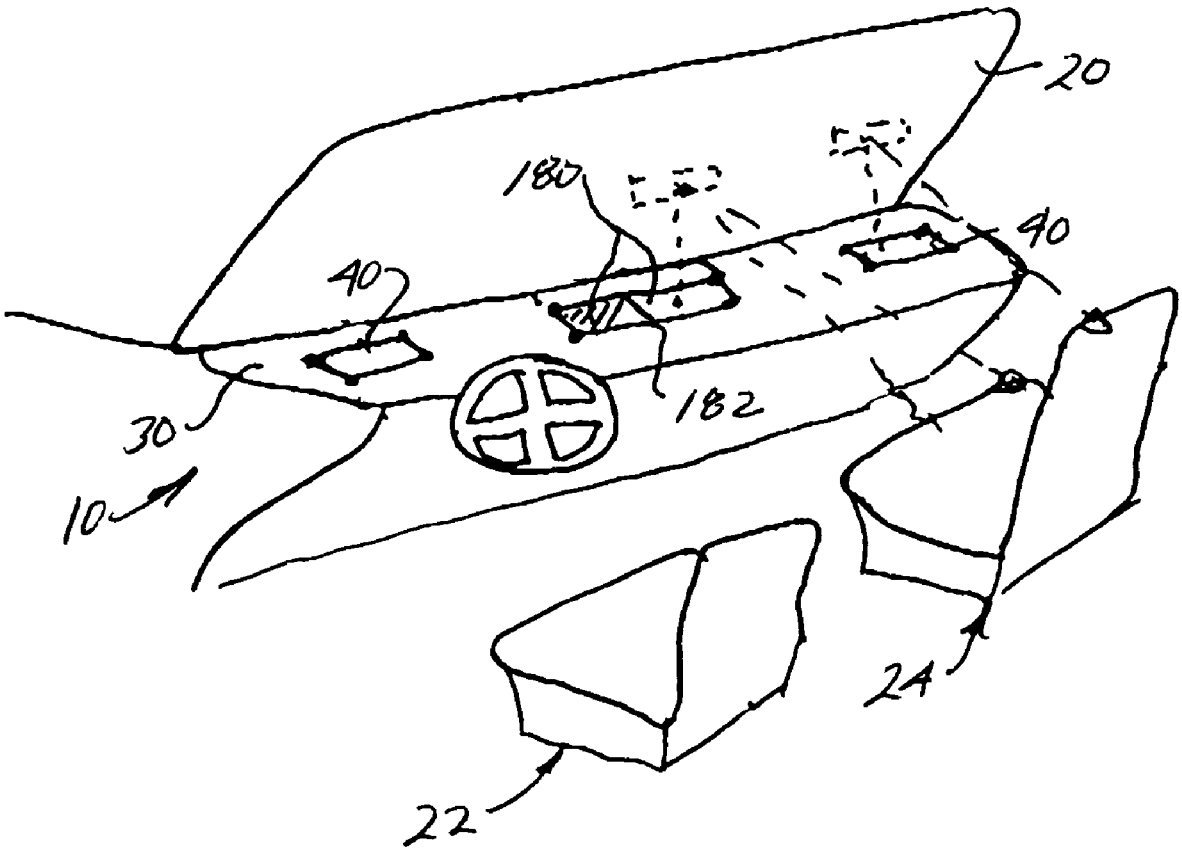
FIG. 9 is an illustrational view of a further embodiment of the invention showing a vehicle audio system with dual circuit speaker and reflected directional stereo sound.

With particular reference to FIG. 9, an embodiment of the invention is shown that combines two speakers into a dual circuit speaker 180 within a single transducer housing 182. As is known in the art, a planar transducer, such as a planar magnetic type, can have two or more circuits on the same diaphragm. Each circuit can be connected to different electrical signals. In such a case, the right and left channel of each corresponding pair of transducers or speakers may be used to provide individual stereo sound to both front passenger listening locations. The advantages of this design include reducing the number of mounting holes or openings and related mounting parts. The dual circuit design can be applied to the direct system design of FIG. 5 in a similar manner.

An additional embodiment using the dual circuit directional speaker 180 is to replace each pair of directional speakers 40 shown in FIG. 1, with a dual circuit directional speaker 180 connected to the left and right channel output for each listening position. This design has the advantage of reducing the overall number of components and mounting holes or openings while retaining stereo image quality.

The embodiments described provide an improved audio imaging advantages of a directional reflected audio system, particularly applicable to automotive vehicles. The invention can be similarly applied to other configurations with an angled reflective surface and substantially fixed listening position, such as found in specialized displays.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A sound system for providing reflected stereo audio to a listening position in a vehicle, comprising:

a. a first smooth surface oriented at an upwardly inclined angle toward the listening position;

b. a second surface positioned at an acute angle with respect to said first smooth surface forward of the listening position and facing said first smooth surface; wherein said first smooth surface is a front windshield and the second surface is a portion of a front dashboard;

c. first and second planar magnetic transducers mounted to said second surface so as to be oriented toward said first smooth surface and wherein each of said first and second planar magnetic transducers includes a diaphragm having an elongated central axis;

d. an acoustic enclosure mounted beneath each of said first and second transducers and said second surface;

e. said first and second transducers being mounted relative to said second surface such that the elongated central axes of said diaphragms thereof are generally aligned and are oriented parallel to the listening position and with said first and second transducers being spaced from each other so that sound from said first planar magnetic transducer is directed to one ear of a person seated at the listening position and sound from said second planar magnetic transducer is directed to another ear of the person seated at the listening position, whereby audio from the first and second transducers is reflected from the first smooth surface toward the listening position providing stereo imaging; and f. an audio source connected to each of said first and second transducers.

2. An automotive sound system providing direct stereo audio to a listening position located in a vehicle seat, comprising:

a. a first interior surface incline upwardly at an angle facing toward the listening position;

a second interior surface positioned at an acute angle relative to said first interior surface forward of the listening position and facing said first interior surface; wherein said first interior surface is a front windshield and said second interior surface is a portion of a front dashboard;

b. first and second planar magnetic transducers mounted relative to a second interior surface so as to direct audio sound there through toward said first interior surface and wherein each of said first and second planar magnetic transducers includes a diaphram having an elongated central axis;

c. said first and second planar magnetic transducers being oriented such that the elongated central axes of said diaphragms thereof extend generally parallel to the listening position, said first and second planar magnetic transducers being spaced from one another in a general linear arrangement so that sound from said first planar magnetic transducer is directed to one ear of a person seated at the listening position and sound from said second planar magnetic transducer is directed to another ear of the person seated at the listening position, and wherein the audio sound from said first and second planar magnetic transducers is reflected from the first interior surface directly toward the fixed listening location providing stereo imaging; and d. audio source electronics connected to said first and second planar magnetic transducers to create an audio stereo output.

3. The automotive sound system of claim 2 wherein the vehicle seat is a vehicle front seat.

4. The automotive sound system of claim 3 including at least third and fourth planar magnetic transducers mounted within the vehicle interior rearward of the front seat, said third and fourth planar magnetic transducers being mounted such that a elongated central axis of diaphragms associated therewith is generally parallel to the listening position, and said third and fourth planar magnetic transducers being aligned linearly with respect to one another whereby audio sound therefrom is directed toward the front seat.

5. The automotive sound system of claim 4 wherein said third and fourth planar magnetic transducers are mounted so as to direct sound toward a rear window such that sound is reflected from the rear window toward the listening position.

6. The automotive sound system of claim 4 wherein said third and fourth planar magnetic transducers are mounted within a rear of the front seat.

7. The automotive sound system of claim 4 wherein said third and fourth planar magnetic transducers are mounted within a rear deck of the vehicle.

8. The automotive sound system of claim 4 wherein said third and fourth planar magnetic transducers are mounted within an interior roof portion of the vehicle.

9. The automotive sound system of claim 4 including a least one subwoofer mounted within the interior of the vehicle and connected to the audio source electronics.

10. The automotive sound system of claim 4 including at least one subwoofer mounted within the interior of the vehicle generally forward of the front seat and at least one subwoofer mounted rearward of the front seat.

11. The automotive sound system of claim 9 including audio controls mounted to the dashboard for controlling audio output from said first, second, third and fourth planar magnetic transducers and said at least one subwoofer.

12. The automotive sound system of claim 3 including a first set of first and second planar magnetic transducers mounted forward of a first front seat and a second set of first and second planar magnetic transducers mounted forwardly of a second front seat.

13. The automotive sound system of claim 12 including a first set of said third and fourth planar magnetic transducers mounted to direct audio sound toward the first front seat and a second set of third and fourth planar magnetic transducers mounted to direct audio sound toward the second front seat.

14. The automotive sound system of claim 13 including first audio control means for controlling audio sound from said first set of said first and second planar magnetic transducers and said first set of third and fourth planar magnetic transducers toward the first front seat and a second audio control means for controlling audio sound from said second set of first and second planar magnetic transducers and said second set of third and fourth planar magnetic transducers toward the second front seat.

* * * * *